US009508242B2

(12) United States Patent
Podlisker

(10) Patent No.: US 9,508,242 B2
(45) Date of Patent: Nov. 29, 2016

(54) POOL ALARM SYSTEM

(71) Applicant: Stanislav Podlisker, Naharia (IL)

(72) Inventor: Stanislav Podlisker, Naharia (IL)

( * ) Notice: Subject to any disclaimer, the term of this patent is extended or adjusted under 35 U.S.C. 154(b) by 121 days.

(21) Appl. No.: 14/622,275

(22) Filed: Feb. 13, 2015

(65) Prior Publication Data

US 2015/0161870 A1 Jun. 11, 2015

Related U.S. Application Data

(63) Continuation of application No. PCT/IL2013/050688, filed on Aug. 13, 2013.

(30) Foreign Application Priority Data

Aug. 30, 2012 (IL) ..... 221729

(51) Int. Cl.
*G08B 23/00* (2006.01)
*G08B 21/08* (2006.01)
*G08B 29/18* (2006.01)

(52) U.S. Cl.
CPC ..... *G08B 21/08* (2013.01); *G08B 29/183* (2013.01)

(58) Field of Classification Search
CPC ..... G08B 21/08; G08B 21/084; G08B 25/10
USPC ..... 340/573.6, 539.1, 565, 552, 541; 367/136, 157
See application file for complete search history.

(56) References Cited

U.S. PATENT DOCUMENTS 4,187,502 A 2/1980 Beverly et al.
4,189,722 A 2/1980 Lerner
4,533,907 A 8/1985 Thatcher
4,604,610 A 8/1986 Baker et al.
4,747,085 A 5/1988 Dunegan et al.
5,023,593 A 6/1991 Brox
5,091,714 A * 2/1992 de Solminihac ..... A62B 99/00 340/539.1
5,121,104 A * 6/1992 Nelson ..... G08B 21/082 340/566
5,144,285 A * 9/1992 Gore ..... G08B 21/088 340/531
5,162,777 A 11/1992 Kolbatz
5,369,623 A 11/1994 Zerangue
6,583,724 B1 * 6/2003 Rodriguez ..... G08B 21/084 340/522
7,019,649 B2 * 3/2006 Hoenig ..... G08B 29/185 340/566
2008/0010422 A1 1/2008 Suzuki et al.
2008/0174441 A1 * 7/2008 Durand ..... G08B 21/084 340/573.6
2010/0176956 A1 * 7/2010 Moerschell ..... G08B 21/182 340/573.6

* cited by examiner

*Primary Examiner* — Phung Nguyen
(74) *Attorney, Agent, or Firm* — Mark David Torche; Patwrite LLC

(57) ABSTRACT

Pool alarm system for detecting the introduction and/or presence of a body in a liquid pool. The system includes: a first sensor for sensing audio signals generated by the body in the pool; a second sensor for sensing water pressure signals generated by the body in the pool; an analog signal processor for pre-processing the audio signals and water pressure signals and for converting them to digital data; an alarm device activated when the body was detected in the pool; a processor and control unit. The audio signals are detected and processed faster than the detection of the water pressure signal. According to the intensity of an acoustic signature originating from the audible signals an aquatic signature originating from the water pressure sensor is analyzed using an adaptable sensitivity parameter dependent on the intensity of the acoustic signature for improving alarm triggering decision.

13 Claims, 3 Drawing Sheets

POOL ALARM SYSTEM

CROSS REFERENCE TO RELATED APPLICATIONS

The present application claims benefit of IL 221729 filed Aug. 30, 2012 and is a national phase entry of international application of PCT/IL201 3/050688, filed Aug. 13, 2013, the contents of which are incorporated herein by reference.

FIELD OF THE INVENTION

The present invention relates to pool alarm systems, more particularly to swimming pool alarms intended to provide alarm warning should a person fall into a swimming pool or in the event of use of the pool by unauthorized persons.

BACKGROUND OF THE INVENTION

There are many circumstances in which it may be desirable or necessary to provide a safety device for pond or swimming pools to detect and indicate that foreign body has been introduced into the pool, or is otherwise present in a liquid pool such as the swimming pool or pond which can be detected and indicated quickly and reliably that a small child or pet may have fallen into the pool.

One of the principles for triggering swimming pool alarms when a person, pet or any other body falls into the pool is for example to trigger an alarm in response to surface disturbances of the pool water. When the disturbances are greater than a predetermined magnitude the alarm is triggered and activated. This type of alarm triggering might be a falsely trigger signal mainly because of wind or surface turbulence caused by other external factors or forces. Another principle for triggering swimming pool alarms is to trigger the alarm when pressure variations of aquatic waves are sensed and analyzed against predetermined pressure variation model. These types of alarms are too readily set off by minor water disturbances if it is to be sensitive enough to trigger alarm in response to a small baby falling into the water. Another principle for triggering swimming pool alarms is based on acoustic wave sensing. One of the drawbacks with this type of alarm is that it can be triggered by loud noises external to the pool, for example. Another principle for triggering swimming pool alarms is based on sonar wave sensing. Different types of swimming pool alarm triggering, some of them discussed hereinabove, are addressed for example in U.S. Pat. No. 4,189,722; U.S. Pat. No. 4,187,502; U.S. Pat. No. 4,533,907; U.S. Pat. No. 4,604,610; U.S. Pat. No. 4,747,085; U.S. Pat. No. 5,023,593; U.S. Pat. No. 5,162,777; U.S. Pat. No. 5,369,623; U.S. Pat. No. 6,583,724; U.S. Pat. No. 7,019,649; US2010/176956; GB2376553; and WO2007/060378.

GB 2376553 discloses a floating water safety device including a subsurface pressure sensor consisting of a piezo electric transducer located between a sealed chamber and an open chamber that allows water to enter through vents. Changes in water pressure result in flexing of the piezo electric transducer providing a detectable output to a processor unit. The device also analyses surface wave motion. A ball is housed within a half sphere vessel that has a rough inner surface. A pimple prevents the ball from remaining stationary. The vessel has a lid to retain the ball. As the device rocks with the waves, the ball will move within the vessel creating vibrations due to the rough inner surface. These vibrations are detected by a piezo electric transducer located in the chamber. The transducer supplies an output to the processor unit. A processor algorithm determines the state of alarm by constantly analyzing both inputs from the two detectors. Vibrations detected using the second detection method will only trigger an alarm state if a change of water pressure has also been detected.

U.S. Pat. No. 4,189,722 discloses a system to determine the presence of an intruder in a swimming pool by detecting a predetermined change in water level caused by displacement. The surface of the pool water forms the lower boundary of an air filled acoustic cavity, and cavity resonance is excited therein by a sonic transducer coupled to the cavity and also to a signal amplifier, causing the cavity to determine the frequency of oscillation of the feedback amplifier. A rise in water level caused by intruder displacement decreases the vertical dimension of the cavity so that the cavity has a different resonant frequency than before intrusion, and the amplifier therefore oscillates at a different frequency. The predetermined change in amplifier signal output frequency is sensed by an electrical network and converted to an alarm device activating signal to indicate an intrusion.

U.S. Pat. No. 4,533,907 discloses a swimming pool alarm in the form of a compact unit which floats on the water in a swimming pool and which may be anchored to the side of the pool. The unit includes a hollow tubular probe which extends down below the surface of the water in the pool. The probe has an open bottom and a top closed by a flexible metal diaphragm. A piezoelectric ceramic member is attached to the upper surface of the diaphragm, and it serves to detect movements of the diaphragm in response to pressure changes in the air trapped in the upper portion of the probe. An electric circuit is connected to the piezoelectric ceramic member to activate and latch an electric alarm when the air pressure exceeds a predetermined threshold indicating, for example, that wave action in the pool has exceeded a predetermined level due to the fact that someone has fallen into the pool.

U.S. Pat. No. 4,747,085 discloses a swimming pool alarm system for actuating an alarm in response to the movement of a person in a swimming pool. The system includes a transmitter mounted below the surface of a swimming pool to continuously transmit ultrasonic sound waves through the body of water, and a similarly positioned receiver detects sound waves in the water and generates an electrical signal in response thereto. The electrical signal is continuously monitored, and the movement of a person in the pool alters the received ultrasonic sound waves and the corresponding electrical signal to produce an alarm signal for actuating an alarm indicator.

U.S. Pat. No. 4,604,610 discloses a swimming pool alarm has a hydrophone located well below the surface of the pool and spaced from its walls, the hydrophone being associated with a captive sensor element which responds to vertical wave motion of the pool water at levels well below the surface by impacting the hydrophone transducer. The hydrophone is associated with an amplifier and peak detector, elevation of the detector output above a set threshold triggering an alarm either responsive to high level audio signals reaching the hydrophone, or to deep water disturbance within the pool.

U.S. Pat. No. 4,187,502 discloses a swimming pool alarm system of the pressure transducer type employs an omnidirectional hydrophone which is held immersed in the swimming pool by means that mechanically decouples the hydrophone.

WO2007/060378 discloses a safety device for detecting the introduction and/or presence of a foreign body or object in or on a body of liquid. The safety device firstly comprising a first liquid-communicating detection means for detecting a first parameter from the liquid, said first parameter being indicative of the possible introduction and/or presence of a foreign body or object in or on the body of liquid. Secondly the device comprises a second air-communicating detection means for detecting a second parameter from the air located around the liquid, said second parameter being indicative of the possible introduction and/or presence of a foreign body or object in or on the body of liquid. Finally the device comprises an indicating means, which indicates the introduction and/or presence of a foreign body or object in or on the body of liquid only in the event at least both said first and second parameters are detected by said first and second detection means respectively.

U.S. Pat. No. 5,023,593 discloses a pool security system incorporates a passive infrared element and an underwater acoustic element. The passive infrared detection element generates a thin infrared layer which overlays the entire water surface area of the pool. As a heat generating body passes through the infrared layer, the infrared element detects the body and generates a first detect signal. As the body enters the water, it causes waves which propagate through the water. These waves are detected by the acoustic element. The acoustic element continues to receive waves generated as the body struggles at or below the water surface. A master control circuit is coupled to the infrared and the acoustic elements to receive the first and second detect signals. The master control circuit is designed to detect when the first detect signal is received, followed a predetermined time by the second detect signal. When this occurs, the master control circuit will generate an alarm signal, thus alerting others of the danger.

U.S. Pat. No. 6,583,724 discloses a pool alarm system for alerting when an object such as a child has entered a pool filled with water. The pool alarm system includes a sensor assembly for detecting when an object has entered the water in a pool. The sensor assembly includes a housing that is mountable on a side wall of the pool. A first sensor is mounted on the housing for detecting movement of the surface of the water. In one embodiment of the present invention, the first sensor is designed to detect surface movement of the water in the pool caused by an object entering and disturbing the surface of the water. A warning assembly is provided for warning an individual in a vicinity of the pool that the sensor has been activated. The warning assembly preferably includes a speaker that is mounted on the housing for emitting sound to audibly warn an individual in a vicinity of the pool that the sensor has been activated.

U.S. Pat. No. 5,162,777 discloses an alarm device placed in the water of a swimming pool for monitoring the swimming pool by triggering an alarm in response to changes in water pressure or sound as a result of persons falling into the swimming pool. The device includes a switch element and wave detector, as well as an acoustic alarm. A covering device or shelf, placed below the water surface and above the detector device is an integral component of the alarm device. The covering device includes a parabolically designed wall which is placed around the detector and is in hydraulic connection with it.

U.S. Pat. No. 5,369,623 discloses a system for use in detecting the presence of a foreign body in liquid, such as a swimming pool or the like, at least one transducer support is immersed in the swimming pool or other body of liquid to be monitored. The transducer support has a plurality of transducer means mounted on the support which are capable of sending and receiving acoustic energy. The present invention also comprises a control means for sequentially activating the transducers to generate a series of time-spaced acoustic pulses sequentially from the transducers, and a means responsive to changes in a reflected echo pattern received at one of the transducer means for the expiration of a pre-determined time period, and thus indicative of a foreign object in the transmission path for generating an appropriate alarm function such as a visual or audio alarm.

US 2010/176956 discloses a water condition indication system for a swimming pool comprising a water condition sensor, a memory and a processor and alarm. The memory collects and stores the information. The data processor filters the water condition information, corrects for perturbations, and generates an alarm when a body fall into a pool causes a change in the water condition that exceeds a predetermined body entrance criterion. Analysis of the output of one or more filters reduces the occurrence of false alarms while still providing a substantially rapid response time under the prevailing conditions.

US 2010/176956 discloses a device enabling an alarm to be triggered in the event of a fall into a swimming pool, and preventing false alarms caused by disturbing elements such as the wind. The device consists of a probe which is submerged in the liquid used to retransmit the aquatic waves varying in pressure in the compression chamber, a piezo-electric-type sensor which is located inside said chamber and used to convert the pressure variations into electrical voltage, another identical sensor located in the housing and enabling the electronic card to subtract the two sets of information enabling the vibrations, in addition to the noise caused by the wind on the housing, to be eliminated, and an electronic card which is used to control a siren for alerting the parents. The device can optionally pilot a radio emitter for controlling a deported siren.

U.S. Pat. No. 7,019,649 discloses a pool monitoring system includes a hydrophone configured to generate an electrical signal in response to receiving a pressure wave in the liquid of a pool, and a processor configured to receive the electrical signal and generate a trigger signal, when the electrical signal includes a characteristic signature over a time period within a predetermined range of time periods.

As described above, there are many principals of swimming pool alarms triggering. However, none of these principals have been entirely satisfactory, the major problem being to provide sufficient sensitivity to trigger the alarm whenever it should be triggered without incurring a large amount of false alarms. Whilst from the point of view of demonstration, a high sensitivity to water disturbance is impressive, in practical use it is an unmitigated nuisance unless accompanied by some ability to discriminate between disturbances which require investigation, and those which do not, such as wind and other disturbances.

A pool alarm system having a robust near zero false triggering rates would be favorable. However, eliminating miss detection is possible by merely increasing sensitivity, resulting in an increase probability of false triggering on one hand, while decreasing false alarm triggering can be done by reducing sensitivity which leads to increase in miss detection, on the other hand. Hence, one object of the present invention is to provide a system and method for reducing the false alarm triggering that caused by environmental conditions such as wind gusts which may create similar pressure fluctuations of a body fall to a swimming pool. In various weather conditions high water agility leads to miss detection. The detection of time is often long because aquatic waves propagate slowly which may limits the maximum allowable pool dimensions. Thus another object of the present invention is to provide a system and method that increases detection time response in pools particularly those with large dimensions. Another object of the present invention is to shorten the response time between an event of a falling object to a pool and the alarm triggering. Yet another object of the present invention is to improve the reliability of body fall detection in pools.

SUMMARY OF THE INVENTION

The present invention relates to swimming pool alarms intended to provide warning should a body such as a person fall into an unattended swimming pool or in the event of use of the pool by unauthorized persons.

In accordance with an embodiment of the present invention there is provided a pool alarm system for detecting the introduction and/or presence of a body in a liquid pool. The system includes a first sensing means for sensing audible signals generated by the introduction and/or presence of the body in the liquid pool. A second sensing means for sensing water pressure signals generated by the introduction and/or presence of the body in the liquid pool. An analog signal processing unit is provided for pre-processing the audible signals, pre-processing the water pressure signals and for converting the pre-processed signals to digital data. The system further includes an alarm device activated when a body was detected in the liquid pool. A processor and control unit is used for processing the digital data and control the alarm device. Wherein, the audible signals are detected and processed faster than the detection of the water pressure, and whereby, according to the intensity of an acoustic signature originate from said audible signals an aquatic signature originate from said water pressure sensor is analyzed by using an adaptable sensitivity parameter dependent on the intensity of said acoustic signature signal for improving alarm triggering decision.

In accordance with another embodiment of the present invention, if the control and processing unit decides that the intensity of the acoustic signature is greater than a predetermined intensity level then a high sensitivity level is determine to the water pressure signal when analyzing water pressure signature. If the control and processing unit decides that the intensity of the acoustic signature is smaller than the predetermined sensitivity level then a low level sensitivity is determine to the water pressure signal when analyzing water pressure signature. Thereby, a body can be detected in the swimming pool even when the intensity of the acoustic signature is weak but on the other hand the intensity of the water pressure signature is high. Vice versa, a body can be detected in the swimming pool even when the intensity of the water pressure signature is weak but on the other hand the intensity of the acoustic signature is high.

BRIEF DESCRIPTION OF THE DRAWINGS

The invention may be understood upon reading of the following detailed description of non-limiting exemplary embodiments thereof, with reference to the following drawings, in which.

Figure 1:
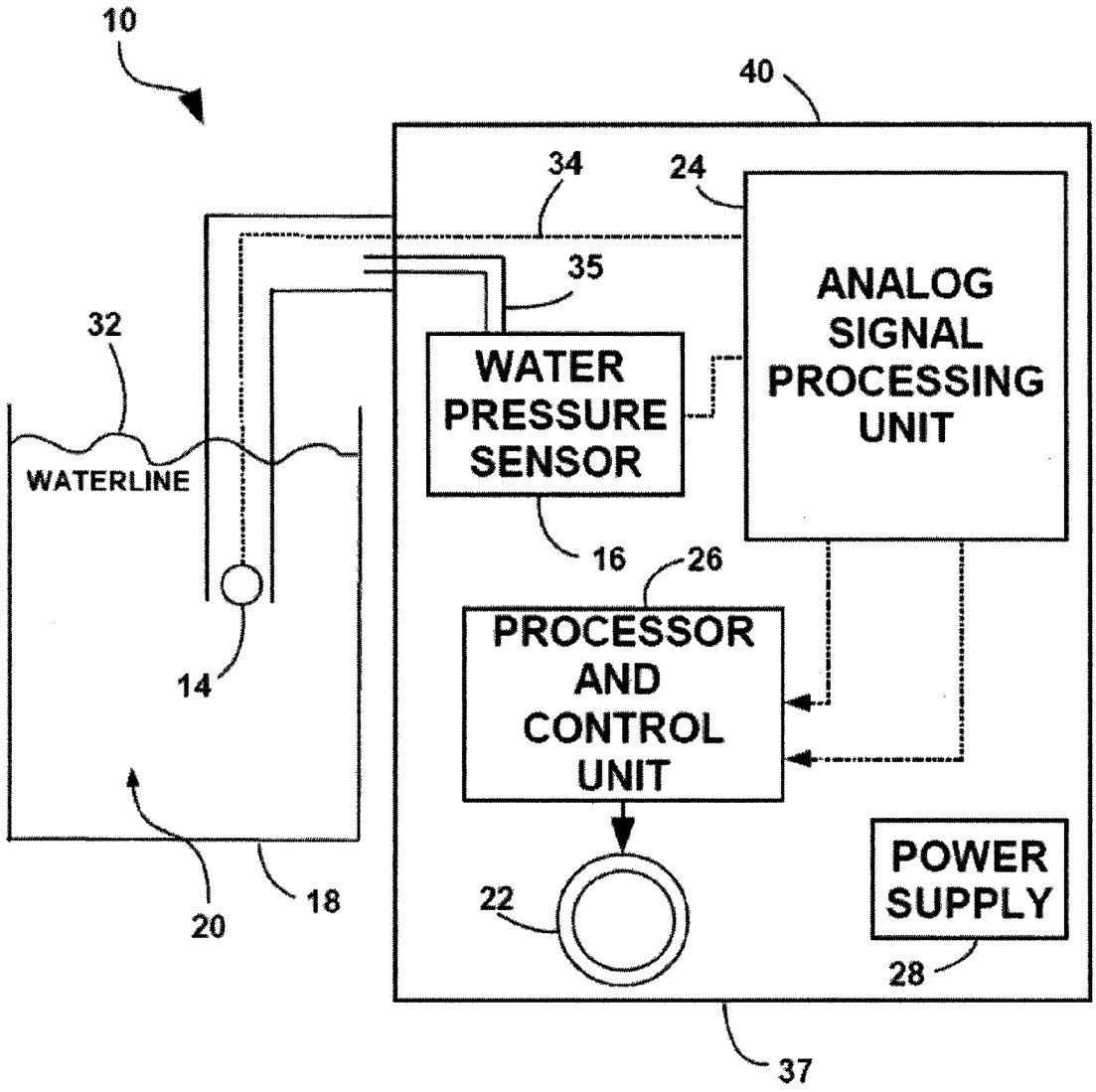
FIG. 1 is a schematic block diagram of a pool alarm system according to an exemplary embodiment of the present invention.

The following detailed description of the invention refers to the accompanying drawings referred to above. Dimensions of components and features shown in the figures are chosen for convenience or clarity of presentation and are not necessarily shown to scale. Wherever possible, the same reference numbers will be used throughout the drawings and the following description to refer to the same and like parts.

DETAILED DESCRIPTION OF THE INVENTION

In accordance with preferred embodiment of the present invention there is provided a swimming pool alarm system 10 having sonar 14, preferably a passive sonar type. Sonar 14 is combined with a water pressure sensor 16, for detecting a person or animal fall into a swimming pool 18 or in the event of use of pool 18 by unauthorized persons. The passive sonar 14 is preferably a hydrophone that acts as a passive listening device for use under waterline 20 and which is capable of converting acoustic signals or sound pressure waves present in pool 18 underneath the waterline 20 to analog electric signals. Hydrophone 14 is preferably designed to detect acoustic signals in the frequency range between 1 KHz to 8 KHz. Empirically, the introduction or fall of an object or body into swimming pool 18 is typically in this acoustic frequency range. Thus, acoustic signals which are outside of this frequency range will consider as an acoustic noise and can be attenuated for example in the analog signal processing unit 24 or by a filter stage installed close to hydrophone 14, not shown. The term "body" generally refers to mass capable of displacing water when immersed in a pool such as a person, animal or inanimate object.

In some embodiments of the present invention sonar 14 can be active sonar, which means that it can emit an acoustic signal and then switch to passive mode to detect it, while in other embodiments of the present invention sonar 14 is simply passive devices that listen to acoustic energy. When the active sonar is used the sonar sends out pulses of sound energy underwater which bounce off objects in their path, sending back an acoustic picture of the underwater swimming pool terrain and acoustic signatures of a body or object fall into the swimming pool 18. The term "signature" generally refers to the acoustic or water pressure profile characteristics of particular body or object such as animal, a child etc.

The sonar 14 and the water pressure sensor 16 provide electrical output signals to analogue signal processing unit 24. The processed analog signals are output to a processor and control unit 26. A processor algorithm determines the state of alarm 22 by constantly analyzing both inputs from the two detectors 14 and 16. Power supply 28 supplies electrical energy to the electrical component of system 10, for example power supply 28 supplies electrical energy to alarm device 22, processor unit 26 and analog signal processing unit 24.

The processor and control unit 26 actuates the alarm device 22 in response to the introduction and/or presence of a person, animal or any other foreign body or object in swimming pool 18. This combination of the sonar 14 and the water pressure sensing 16, also has the capability of discriminating between false and true alarm conditions. Moreover, this combination is able to detect and alert quickly even fall of a small body into the pool water. The implementation of the present invention can be installed in different liquid pool sizes in particularly large pools and still keeping high sensitivity detection of small object or body in pool 18 and eliminating false alarms.

In accordance with the present invention the fast and reliable object or body detection in the pool water 18 or any other liquid pool is mainly established by utilizing the fast propagating sonic waves generated as an object or body interact with the pool water 20, while the undesired effect of discriminating large amplitudes of sound of too small bodies is being backed up by underwater aquatic wave pressure detection detected by water pressure sensor 16. The underwater aquatic wave detection is then processed and analyzed for easily discriminate between false small size acoustic signatures from large significant ones.

Sonar 14 is preferably a hydrophone that is placed about 30 cm under the waterline 32. The hydrophone 14 generates an electrical signal in response to sound waves or sonic wave present in pool 18 caused by object or body introduced to the water pool. This electrical signal after being pre-amplified and filtered is transferred by a waterproof conductor cable 34 to analog signal processing unit 24. Preferably, cable 34 is inserted within an air pressure pipe 36 connected in one end to the pool alarm housing 40. Pool alarm housing 40 may be conveniently positioned on the decking by the pool 18. Portion of pipe 36 is inserted beneath the pool waterline 32. Preferably, pipe 36 is inserted about 30 cm under waterline 32. Air pressure pipe 36 transfers the aquatic air-pressure signals into the aquatic water pressure sensor 16. Preferably, water pressure sensor 16 is designed to detect water wave signals in the frequency range between 0.5 to 2 Hz.

The hydrophone 14 is positioned under water near the pipe second open end. Pre-amplifier and filtering stage, not shown in FIG. 1 are installed close to hydrophone 14 and are used to pre-amplify and filter the analogue electronic signal generated from hydrophone 14 in response to sonic pool waves. The preamplifier and filter stage, not shown, can be located close to hydrophone 14 preferably connected at pipe 36 end for reducing electronic noise that for example may introduced along cable 34 and/or to attenuate acoustic signals which are outside of the sound frequencies that are generated from a falling object or body to pool 18 filed with liquid. A water pressure tube 35 is positioned in one end inside pipe 36 and in the other end connected to the water pressure sensor 16. The air pressure tube 40 is used to transfer entrapped air inside pipe 36 and above the water line into the water pressure sensor 16, which is preferably positioned in the alarm pool housing 37. The water pressure sensor 16 converts the interrupted air into electric signal. In other embodiment of the present invention the water pressure tube 35 is fully positioned under the pool waterline 32 such that the water pressure sensor 16 converts the interrupted water in tube 35 into electric signal.

The output that comes from the preamplifier and filter stage along with the output that comes from water pressure sensor 16 are collected in the analog signal processing unit 24. The analog signal processing unit includes series of filters, amplifier stages, signal level shifting and analog to digital converter for converting the sonic and aquatic analog signals to digital. Optionally, the analog signal processing unit 24 may also include a multiplexer, to multiplex between the sonic and aquatic analog signals. The converted aquatic and sonic digital signals are read by processor and control unit 26.

Processor and control unit 26 includes the system's CPU, an on chip program memory, RAM and EEPROM preferably designed with flash memory technology. The controller 26 is responsible for controlling all system's timing, the ON/OFF power to all system's units. The controller 26 is further responsible for the sampling of the two analogue signals namely the acoustic and the aquatic air-pressure signal. The controller 26 is further responsible for activating or deactivating the on-system siren that comes from the alarm device 22. Processor and control unit 26 further includes the program code execution responsible of real-time processing of the detected signals that comes from the water pressure sensor 16 and hydrophone 14. The program code determines conditions of detection and rejecting conditions of false alarm triggering.

The implementation of the present invention is able to service bigger size swimming pools and with different shapes by using single alarm system 10. Practically, the detection time is reduced mainly because of reduction of memory buffer size necessary for event validation process of true or false detection. The control and processing unit 26 has a computation power, provides signal processing and analysis software and algorithms necessary for a reliable detection and to avoid false alarms. The collected digital data that is originated from water pressure sensor 16 and hydrophone 14 and pre-processed by the analog signal processing unit 24 is transferred to the control and processing unit 26. When run through series of algorithms, the collected data is being compared in real-time with mathematical models of "true or false scenarios" and their strengths are compared with pre-computed thresholds. If both signals are found to match one such "true fall scenario" mathematical model, and their signal strengths are found to supersede their thresholds, an alarm signal is triggered alerting people around to gather and rescue the fallen person or animal.

In accordance with some embodiments of the present invention the pool alarm system 10 further includes one or more temperature sensors that measure the ambient temperature of swimming pool 18 for fine tuning the mathematical models described above and also to increase the accuracy of sensors 15 and 16 particularly in an environment with unstable temperature conditions.

In accordance with some embodiments of the present invention the pool alarm system 10 further includes a pool ambient light sensor, not shown. This enables to adjust the threshold signal strengths described above as a function of the hour in a day (or night).

Figure 2:
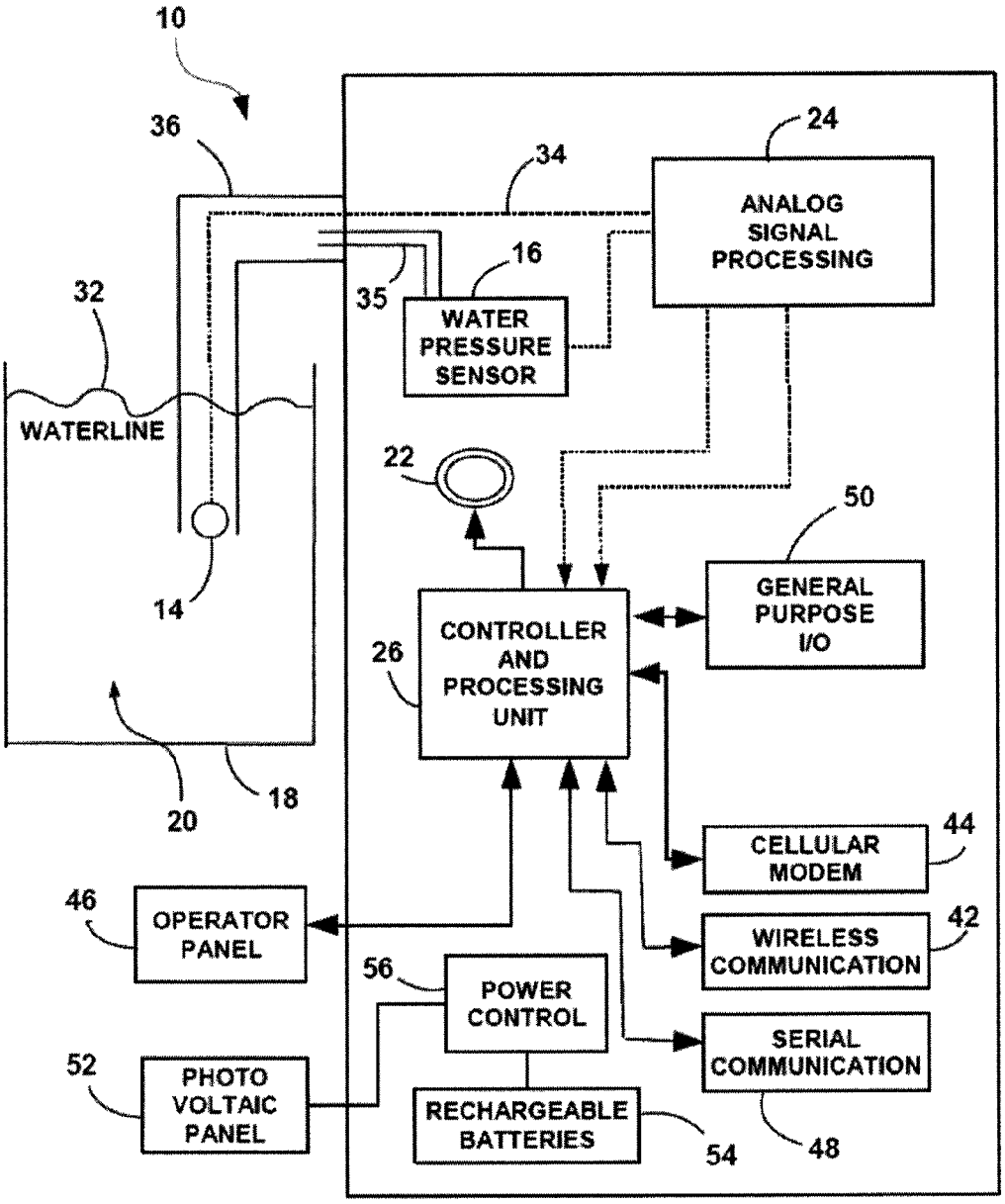
FIG. 2 is a schematic block diagram of a pool alarm system including various options and features according to exemplary embodiments of the present invention.

Referring now to FIG. 2, optionally pool alarm system 10 includes wireless transceiver 42 controlled by the controller and processing unit 26. Preferably, the wireless transceiver 42 is in the frequency range of a 2.4 GHz. Transceiver 42 is used for example to communicate and control one or more alarm devices positioned remotely from pool 18 and/or indoor. The remote alarm may also have a wireless transceiver to communicate with wireless transceiver 42. The remote alarm device, not shown, will be activated when an object or body fall into the swimming pool 18 is detected by the pool alarm system 10. In some embodiments of the present invention wireless transceiver 42 can communicate with cordless telephone to notify when an object or body fell into the swimming pool 18 is detected by the pool alarm system 10. In some embodiments of the present invention pool alarm system 10 includes a cellular modem 44 controlled by controller and processing unit 26. Cellular modem 44 can communicate with one or more cellular phones. For example, cellular modem 44 can communicate with cellular phones of the swimming pool owners to immediately notify when an object or body fell into the swimming pool 18 is detected by the pool alarm system 10. The notification can be provided for example by sending a short message service (SMS) or by calling to the cellular phones of the swimming pool owners. In other embodiments of the present invention the mode of operation of the pool alarm system 10 can be changed remotely by sending instructions to system 10 by using cellular or cordless phone. For example, the owner of the pool 18 can remotely communicate with the cellular modem 44 for instructing the controller and processing unit 26 to deactivate the alarm device 22 if the alarm device has been activated before the communication.

Figure 3:
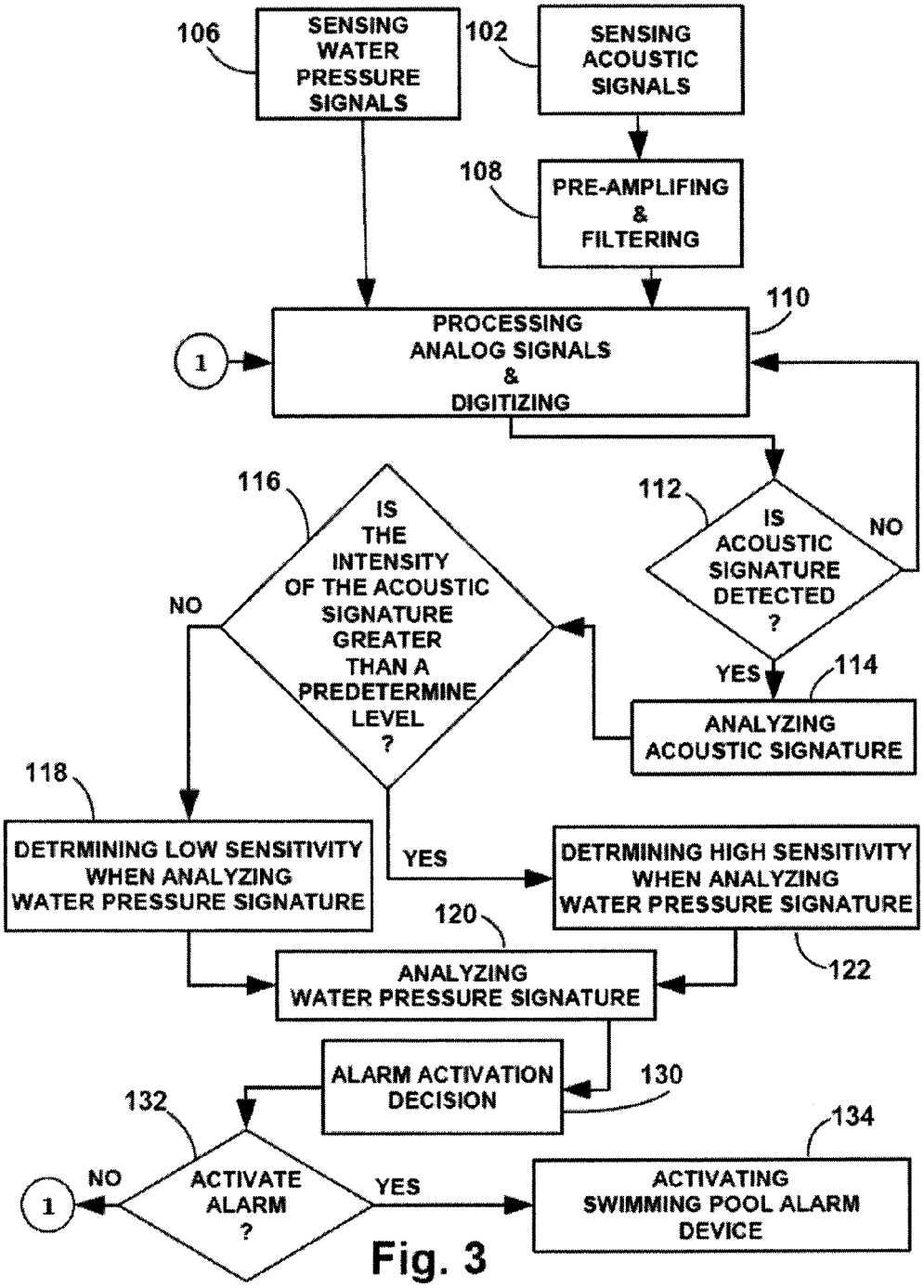
FIG. 3 is a flow chart illustrating a process for detecting the entry of a body into a pool in accordance to exemplary embodiments of the present invention.

The pool alarm system 10 may also include an operator panel interface 46 and a serial communication channel 48 both of them are controlled by the controller and processing unit 26. Through the operator panel interface 46 the user can instruct the controller and processing unit 26 to manually arm/disarm the alarm system 10 disable the system's siren etc. In some embodiments of the present invention pool alarm system 10 may also include a general purpose I/O 50 which enables to control external devices such as pool pumps, swimming pool cleaners. In some embodiments of the present invention the pool alarm system 10 may equipped with a photo-voltaic panel 52 for efficiently powering the system and optimal power saving. The photo voltaic panel 52 and rechargeable batteries 54 are electrically connected to power control 56. Referring now to FIG. 3, there is shown a flow chart illustrating the process for detecting the entry of a body into a pool in accordance with some embodiments of the present invention. It should be noted that some steps of the illustrated process can be combined, executed repeatedly, omitted and/or rearranged. In step 100 the pool water pressure is continuously sensed and converted to analog electrical signal for example by using water pressure sensor 16. In step 102 the pool underwater acoustic signals are continuously sensed and converted into analog electrical signals for example by using hydrophone 14. In step 106, the detected acoustic electrical signals are being pre-amplified and pre-filtered in step 108. In step 110 the pre-amplified acoustic electric signals and the water pressure electric signals are being processed and digitized in the analog signal processing unit 24. The control and processing unit 26 has a computation power, provides signal processing and analysis software and algorithms necessary for a reliable detection and avoiding false alarms. The collected digital data that represent the detection signal from water pressure sensor 16 and hydrophone 14 when run through series of algorithms are being compared in real-time with mathematical models of "true fall scenarios" and their strengths are compared with pre-computed thresholds. In step 112 if an acoustic signature was detected by control and processing unit 26 then the control and processing unit 26 analyzes the acoustic signal in step 114. If an acoustic signature was not detected by control and processing unit 26 then the analog signals that originate from water pressure sensor 16 and hydrophone 14 for possible acoustic or aquatic signatures are continually monitored and processed. According to the intensity of an acoustic signature originate from said audible signals an aquatic signature originate from said water pressure sensor is analyzed by using an adaptable sensitivity parameter dependent on the intensity of said acoustic signature for improving alarm triggering. For example, if the control and processing unit 26 decided in step 116 that the intensity of the acoustic signature is greater than a predetermined intensity level then a high level sensitivity is determine in step 118 to the water pressure signal when analyzing water pressure signature in step 120. If the control and processing unit 26 decided in step 116 that the intensity of the acoustic signature is smaller than the predetermined sensitivity level then a low level sensitivity is determine in step 122 to the water pressure signal when analyzing water pressure signature in step 120. The aforementioned steps allow detecting the fall of a body into a water pool or any other liquid pool 18 even in the scenario where the acoustic signature is analyzed as a weak signature but with a strong water pressure signature of the falling body into the pool. Vice versa, the aforementioned steps allow detecting the fall of a body into a water pool or any other liquid pool 18 even in the scenario where the acoustic signature is analyzed as a strong signature but with weak water pressure signature of the falling body into the pool. These scenarios can occur particularly in liquid pools that have irregular shapes. In step 130 according to the analyzing of water pressure and acoustic signatures processing unit output an alert triggering decision. In step 132 if the processing unit decides that a falling body to the water pool 18 was detected then an alarm triggering signal is generated by processing unit 26 to activate in step 134 alarm swimming pool device 22. If the processing unit 26 decides that a body did not fall or the body that fell is not for example an animal or a person then the alarm device will not be activated and the alarm system 10 will continue monitoring swimming pool water pressure and acoustic signals.

It should be understood that the above description is merely exemplary and that there are various embodiments of the present invention that may be devised, mutatis mutandis, and that the features described in the above-described embodiments, and those not described herein, may be used separately or in any suitable combination; and the invention can be devised in accordance with embodiments not necessarily described above.

What is claimed is:

1. A pool alarm system for detecting the introduction and/or presence of a body in a liquid pool, said system comprising:

a first sensing means for sensing audible signals generated by the introduction and/or presence of said body in said liquid pool;

a second sensing means for sensing water pressure signals generated by the introduction and/or presence of said body in said liquid pool;

an analog signal processing unit for pre-processing said audible signals and said water pressure signals and for converting said pre-processed signals to digital data;

an alarm device activated when said body was detected in the liquid pool;

a processor and control unit for processing said digital data and control said alarm device; wherein, said audible signals are detected and processed faster than the detection of said water pressure signal, whereby, according to an intensity of an acoustic signature originate from said audible signals and an aquatic signature originate from said water pressure sensor is analyzed by using an adaptable sensitivity parameter dependent on the intensity of said acoustic signature for improving alarm triggering decision.

2. The system of claim 1, wherein if said control and processing unit decides that the intensity of said acoustic signature is greater than a predetermined intensity level then a high sensitivity level is determine to said water pressure signal when analyzing water pressure signature; if said control and processing unit decides that the intensity of said acoustic signature is smaller than the predetermined sensitivity level then a low level sensitivity is determine to said water pressure signal when analyzing water pressure signature; thereby, a body can be detected in the pool even when the intensity of the acoustic signature is weak but on the other hand the intensity of the water pressure signature is high; and vice versa a body can be detected in the pool even when said intensity of said water pressure signature is weak but on the other hand the intensity of said acoustic signature is high.

3. The system of claim 1, wherein said first sensing means is passive sonar.

4. The system of claim 1, wherein said first sensing means is active sonar.

5. The system of claim 1, wherein said second sensing means is an air pressure sensor.

6. The system of claim 1, wherein said digital data are processed through a series of algorithms and being compared in real-time with mathematical models of "true/fall scenarios" and their strengths are compared with pre-computed thresholds, if both signals are found to match one such "true fall scenario" mathematical model, and their signal strengths are found to supersede their thresholds, an alarm signal is triggered to activate said alarm device.

7. The system of claim 6, wherein said system comprising a third sensing means for sensing the ambient temperature that is in the pool for fine tuning said mathematical models.

8. The system of claim 6, further comprising an ambient light sensor for enabling adjustment of the signal strength of the thresholds as a function of the hour of day/night.

9. The system of claim 1, further comprising a cellular modem for communicating with at least one remote cellular phone.

10. The system of claim 1, further comprising wireless transceiver for communicating with a cordless telephone to notify when an object or body fell into said liquid pool.

11. The system of claim 1, further comprising a serial communication channel.

12. The system of claim 1, further comprising a general purpose I/O which enable to control external devices such as pool pumps, swimming pool cleaners.

13. A method for detecting the introduction and/or presence of a body in a liquid pool comprising the following steps:

sensing water pressure physical signals in said liquid pool and converting said water pressure physical signals into analog electrical signal; sensing acoustic signals in liquid pool and converting said acoustic signals into analog electrical signals;

pre-amplifying and pre-filtering said detected acoustic electrical signals; pre-processing and digitizing said acoustic electric signals and said analog electric signals;

analyzing an acoustic signature originated from said detected acoustic signals;

determining high sensitivity level to the water pressure signal when analyzing water pressure signature if an intensity of the acoustic signature is greater than a predetermined intensity level;

determining low sensitivity level to the water pressure signal when analyzing water pressure signature if the intensity of the acoustic signature is smaller than a predetermined intensity level;

analyzing water pressure signature;

providing alarm activation decision if whether there is introduction and/or presence of a body in a liquid pool by utilizing the analysis of said water pressure and acoustic signatures; and activating a liquid pool alarm device if said decision is that a body introduce to said liquid pool.

* * * * *